United States Patent [19]

Tomida et al.

[11] Patent Number: 4,592,980

[45] Date of Patent: Jun. 3, 1986

[54] PHOTOCONDUCTIVE LAYER HAVING HYDROPHILIC AND HYDROPHOBIC MOIETIES

[75] Inventors: Yoshinori Tomida, Yokohama; Yutaka Hirai, Tokyo; Masahiro Haruta, Funabashi; Yukuo Nishimura, Sagamihara; Hiroshi Matsuda; Takashi Hamamoto, both of Yokohama, all of Japan

[73] Assignee: Canon Kabushiki Kaisha, Tokyo, Japan

[21] Appl. No.: 676,253

[22] Filed: Nov. 29, 1984

[30] Foreign Application Priority Data

Dec. 5, 1983 [JP] Japan ..... 58-228381

[51] Int. Cl.[4] ..... G03G 5/06; G03G 5/14

[52] U.S. Cl. ..... 430/57; 430/56; 430/58; 430/59; 430/79; 430/80; 430/96

[58] Field of Search ..... 430/56, 57, 58, 59, 430/79, 80, 96

[56] References Cited

U.S. PATENT DOCUMENTS

| | | | |
|---|---|---|---|
| 3,210,185 | 10/1965 | Olden | 430/57 X |
| 3,359,101 | 12/1967 | Ito | 430/49 X |
| 3,404,979 | 10/1968 | Bonjour | 430/96 |
| 3,542,546 | 11/1970 | Fox | 430/79 X |
| 3,652,438 | 3/1972 | Jones | 430/56 X |
| 3,704,121 | 11/1972 | Makino et al. | 430/57 X |
| 3,865,869 | 2/1975 | Keuhn et al. | 430/96 X |
| 4,235,958 | 11/1980 | Barraud et al. | 430/311 X |
| 4,415,641 | 11/1983 | Goto et al. | 430/79 X |
| 4,439,507 | 3/1984 | Pan et al. | 430/96 X |

FOREIGN PATENT DOCUMENTS

| | | | |
|---|---|---|---|
| 42-9639 | 5/1967 | Japan | 430/80 |
| 44-6392 | 3/1969 | Japan | 430/96 |
| 50-115039 | 9/1975 | Japan | 430/96 |
| 52-38226 | 3/1977 | Japan | 430/79 |
| 58-43459 | 3/1983 | Japan | 430/79 |

*Primary Examiner*—Roland E. Martin

*Attorney, Agent, or Firm*—Fitzpatrick, Cella, Harper & Scinto

[57] ABSTRACT

A photosensitive member comprises a monolayer or a multi-layer structure film, the film being constituted of one or more film forming molecules, the film forming molecule having a hydrophilic moiety and a hydrophobic moiety in the molecule and having photosensitivity.

16 Claims, 8 Drawing Figures

PHOTOCONDUCTIVE LAYER HAVING HYDROPHILIC AND HYDROPHOBIC MOIETIES

BACKGROUND OF THE INVENTION

. Field of the Invention

This invention relates to a photosensitive member, and more particularly, to an electrophotographic photosensitive member.

2. Description of the Prior Art

Heretofore, there have been known techniques utilizing photosensitive polymers as a method for producing electrophotographic photosensitive members. According to such techniques, electrophotographic photosensitive members are generally produced by coating a photosensitive polymer on a substrate, or applying to a substrate a polymer in which a photosensitive material is dispersed, or the like.

However, in the case of such electrophotographic photosensitive members, the content of dispersion pigments which are photosensitive materials in the polymer can not be over a certain level since the content exceeding the level results in causing cohering, and therefore, this is one reason why the sensitivity of the electrophotographic photosensitive member can not be increased over a certain level. In addition, the photosensitive materials are in a three dimensional isotropic state in the film formed by coating or the like, or are specifically oriented due to the production conditions or the like such that the orientation is disadvantageous for electrophotography, and therefore, the sensitivity is decreased or the resolution is insufficient.

These disadvantages occur not only in the above-mentioned electrophotographic photosensitive members utilizing photosensitive polymers, but also generally in conventional electrophotographic photosensitive members.

SUMMARY OF THE INVENTION

An object of the present invention is to provide a photosensitive member, in particular, an electrophotographic photosensitive member, free from the above-mentioned drawbacks.

According to the present invention, there is provided a photosensitive member which comprises a monolayer or a multi-layer structure film, the film being constituted of one or more film forming molecules, the film forming molecule having a hydrophilic moiety and a hydrophobic moiety in the molecule and having photosensitivity.

DETAILED DESCRIPTION OF THE PREFERRED EMBODIMENTS

Figure 1:
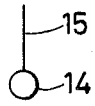
FIG. 1 shows diagrammatically a molecule for explaining the present invention.

The present invention is concerned with a photosensitive member having a single layer structure film or a multi-layer structure film (hereinafter referred to as "monolayer film" or "multi-layer film", respectively; when these films are generally mentioned without distinguishing from each other, they are referred to as "LB film".) as produced by Langmuir-Blodgett method (hereinafter referred to as "LB method").

According to the present invention, the monolayer film or multi-layer film is composed of one or more film forming molecules having a hydrophilic moiety and a hydrophobic moiety in the molecule and having photosensitivity, and is usually formed on a substrate as a supporting member for the film.

The term "monolayer film" means an LB film of a single layer structure composed of one kind of film forming molecule, that is, monomolecular film, or an LB film of a single layer structure composed of two or more kinds of film forming molecules, that is, mixed monomolecular film. The term "multi-layer film" means a monomolecular built-up film where two or more monomolecular films are built-up, a mixed monomolecular built-up film where two or more mixed monomolecular films are built-up, or a built-up film composed of one or more monomolecular films and one or more mixed monomolecular films.

As the film forming molecule according to the present invention, molecules having a hydrophilic moiety and a hydrophobic moiety in the molecule and having photosensitivity may be used.

As such molecules, there may be used molecules having a photosensitive group or a group derived therefrom such as porphyrin ring, anthracene ring, phenenthrene ring, diazo group, polyvinyl group, polyethynyl and the like into which a hydrophilic group, for example, carboxyl group, metal salt thereof and amine salt thereof, sulfonic acid group, metal salt thereof and amine salt thereof, sulfonamide group, amide group, amino group, imino group, hydroxyl group, quaternary ammonium group, hydroxyamino group, hydroxyimino group, diazonium group, quanidine group, hydrazine group, phosphoric acid group, silicic acid group, aluminic acid group or the like; and a hydrophobic group, for example, long chain alkyl group, olefin hydrocarbon group such as vinylene, vinylidene, acetylene and the like, phenylene fused ring phenyl group such as naphthyl, anthranyl and the like, chain linear polyphenyl group such as biphenyl, terphenyl and the like. What is meant by "having a hydrophilic moiety and a hydrophobic moiety in the molecule" is that a molecule has one hydrophilic moiety and one hydrophobic moiety in the molecule, or where there are one or more of hydrophilic moiety and one or more of hydrophobic moiety in the molecule, from the standpoints of the overall structure of the molecule there is the relation that a moiety is hydrophilic as compared with another moiety while the latter is hydrophobic as compared with the former.

What is meant by "having photosensitivity" is that a molecule exhibits at least a charge generation function, a charge transport function, or both of them when irradiated with light. A molecule having only one of both functions, or both functions may be used. A molecule having both functions may have the both functions as a whole or may have the both functions in a function separating way that, for example, the hydrophilic moiety in the molecule functions as a charge generation portion while the hydrophobic moiety functions as a charge transport portion.

Examples having a charge generation function only are anthracene ring, porphyrin ring and the like, and examples having a charge transport function are hydrazine and the like. Examples having the both functions are polyvinylcarbazoles and the like.

These molecules may constitute monolayer film and multi-layer film by using one kind of the molecule.

If desired, monolayer film and multi-layer film may be constituted by using several kinds of molecules in combination. In addition, monolayer film and multi-layer film may be produced by combining the molecule with other film forming molecule having other function such as photosensitization and the like. As a result, the monolayer films and multi-layer films composed of the molecules as above may have charge generation function and charge transport function, alone or in combination. By appropriately using these functions, there can be produced various photosensitive members.

For example, a photosensitive layer of photosensitive members is often constituted of a single layer composed of a material having both a charge generation function and a charge transport function. However, in some cases, these two functions are separated for the purpose of making the film thickness thin and shortening the film forming time and thus the photosensitive layer is constituted of two layers, that is, a charge generation layer and a charge transport layer. According to the present invention, the above-mentioned means may be employed as well.

For example, a monolayer film or multi-layer film having both charge generation and charge transport functions can be used alone as a photosensitive layer while, if a monolayer film or multi-layer film possesses only one function, it is combined with a monolayer film or multi-layer film having only the other function to form a photosensitive layer. Furthermore, in conventional photosensitive layers, one of the charge generation layer and the charge transport layer may be replaced by a monolayer film or multi-layer film having the same function.

A substrate used in the present invention may be electroconductive or insulative. If surfactants or the like are attached to the surface of the substrate, the film forming molecules are disturbed upon forming so that good monolayer film or multi-layer film can not be obtained. Therefore, it is desired to use a clean surface of a substrate. As the electroconductive substrate, there may be used a metal such as stainless steel, Al, Cr, Mo, Au, Ir, Nb, Ta, V, Ti, Pt, Pb and the like and alloys thereof. As the electrically insulating substrate, there may be used a film and a sheet of a synthetic resin such as polyester, polyethylene, polycarbonate, cellulose triacetate, polypropylene, poly(vinyl chloride), poly(vinylidene chloride), polystyrene, polyamide and the like, glass, ceramic, paper and the like. At least one surface of electrically insulating substrate is preferably electroconductivized.

The shape of the substrate may be selected from an arbitrary shape such as a cylinder-like, a belt-like, a plate-like and the like, depending on the purpose of use.

For forming a monolayer film or multi-layer film on the substrate, there may be used LB method developed by I. Langmuir et al. LB method is described below referring to a case where the above-mentioned monolayer film or multi-layer film is composed of a molecule of one kind, that is, the formation of a monomolecular film or monomolecular layer built-up film.

According to LB method, a monomolecular film or a monomolecular layer built-up film is prepared by utilizing the phenomenon in a molecule having a hydrophilic group and a hydrophobic group in the molecule that the molecule is formed into a layer on the water surface with the hydrophilic group pending downward when a moderate balance between both groups is maintained. The monomolecular layer on the water surface has the specific feature of a two dimensional system. When the molecules are scattered sparsely, the following equation of two dimensional ideal gas is valid between the surface area A per one molecule and the surface pressure $\pi$, thus forming "gas film":

$$\pi A = kT$$

wherein k is the Boltzman constant and T is absolute temperature.

If A is made sufficiently small, the interactions between molecules are strengthened to form "condensed (or solid) film" of two dimensional solid. The condensed film can be transferred in a layer one by one onto the surface of a substrate such as glass. By use of this method, the monomolecular film or the monomolecular layer built-up film can be produced according to, for example, the procedure as described below.

First, a film forming molecule is dissolved in a solvent, and the resultant solution is developed into an aqueous phase to form a film of the film forming molecule. Next, the gathered state of the film substance is controlled through restriction of its development area by providing a partition wall (or a buoy) so that the film substance may not be expanded too much by free diffusion on the aqueous phase, to obtain a surface pressure $\pi$ in proportion to the gathered state. By moving this partition wall, the development area can be reduced to control the gathered state of the film substance, whereby the surface pressure can be increased gradually to set a surface pressure $\pi$ suitable for production of the built-up film. While maintaining this surface pressure, a clean substrate can be moved vertically therethrough to have the monomolecular film transferred thereon. A monomolecular film can be produced as described above, and a built-up film of monomolecular layers can be formed by repeating the above procedure to a desired degree of built-up.

For transfer of the monomolecular film onto a substrate, in addition to the vertical dipping method as mentioned above, it is also possible to employ a method such as the horizontal attachment method, the rotary cylinder method, etc. According to the horizontal method, the substrate is brought into contact with the water surface horizontally for transfer of the monomolecular layer, while the monomolecular layer is transferred according to the rotary cylinder method by rotating a cylindrically shaped substrate on the water surface. According to the vertical dipping method as mentioned above, when a substrate is drawn up across the water surface, a monomolecular layer with the hydrophilic groups facing toward the substrate side is formed for the first layer on the substrate. When the substrate is moved up and down as described above monomolecular layers are built-up one by one with the progress of the respective steps. Since the orientation of the film forming molecules in the withdrawing step is opposite to that in the dipping step, a Y-type film, in which hydrophilic groups come face to face with hydrophilic groups or hydrophobic groups with hydrophobic groups between layers, is formed according to this method.

In contrast, according to the horizontal attachment method, transfer is effected by bringing the substrate into contact with the water surface horizontally, whereby the monomolecular layer is formed with the hydrophobic groups faced toward the substrate side. According to this method, even when built-up, there is no alteration in orientation of the film forming molecules, and a X-type film with the hydrophobic groups faced toward the substrate side are formed in all the layers. On the contrary, built-up film with the hydrophilic groups faced toward the substrate side in all the layers is called a Z-type film.

According to the rotary cylinder method, the monomolecular layers are transferred by rotating a cylindrical substrate on the water surface. The method for transferring the monomolecular layers onto the substrate surface is not limited to these methods, and it is also possible to apply a method in which a substrate is extruded into the aqueous phase from a substrate roll, when employing a substrate with a large area. Also, the orientation of the hydrophilic groups or the hydrophobic groups toward the substrate as described above is no more than the general principle, and it can be changed by a surface treatment of the substrate or other modifications.

The above-mentioned method is the so-called LB method. When the same method is carried out by using two or more kinds of film forming molecules to be developed on a water surface, there is produced a monolayer film composed of two or more kinds of molecules, that is, a mixed monomolecular film, or a multilayer film constituted of built-up mixed monomolecular layers, that is, a mixed monomolecular built-up film.

For building up monolayers of different kinds, the the following method is used. For example, when a monolayer film A composed of a film forming molecule A' and a monolayer film B composed of a film forming molecule B' are superposed, molecules A' are first developed on a water surface and then the monolayer film A is formed on a substrate according to the above-mentioned method. After removing the resulting monolayer film A from the water furface, molecules B' are developed on a water surface and a monolayer film B is formed on the monolayer film A. Repeating the above-mentioned procedures, there is formed a desired multilayer film composed of built-up monolayer films of different kinds.

The LB film on the substrate is fixed sufficiently firmly and it will scarcely be peeled or peeled off from the substrate, but it is also possible to provide an adhesive layer between the substrate and the LB film for the purpose of reinforcement. Further, the adhesive force can also be strengthened by choice of the LB film forming conditions, e.g. the hydrogen ion concentration or the ion species in the aqueous phase or the surface pressure.

Further, various layers which are usually provided for improving mechanical, electrical or optical characteristics in the art of electrophotographic photosensitive member, such as a surface protective layer, an electroconductive layer, a reflection preventing layer and the like, may be optionally disposed on or under or between these LB films.

Referring to the drawing, the photosensitive member, in particular, electrophotographic photosensitive member, will be described in detail below.

FIG. 1 is a model of one molecule for a monomolecular layer according to the present invention. Here, the molecule is depicted by using only the hydrophilic moiety 14 and the hydrophobic moiety 15 omitting the detailed molecular structure.

As mentioned above, a molecule having a hydrophilic moiety 14 and a hydrophobic moiety 15 may have both a charge generation function and a charge transport function as a whole, or may have only one of the two functions. A molecule may have hydrophobic moiety 14 as a charge generation portion and a hydrophobic moiety 15 as a charge transport portion, and vice versa, that is, the function separation can be achieved in a molecule.

Figure 2:
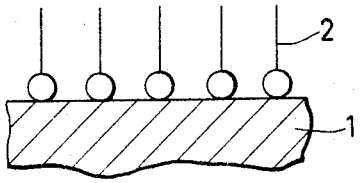
FIGS. 2, 3, 4, 7 and 8 are schematic cross-sectional views showing minute structures of embodiments of the electrophotographic photosensitive member according to the present invention.

In addition, it is possible to introduce into the molecule a group or another molecule capable of imparting such property, for the purpose df improving photosensitization property or the like, FIG. 2 shows one example of the electrophotographic photosensitive member of the present invention and a schematic vertical section. It shows a construction of monomolecular film 2 formed by LB method on an electroconductive substrate 1. According to properties of LB film, each molecule having photosensitivity is arranged in an orderly fashion such that hydrophobic moiety 15 is at a side opposite to substrate 1 and hydrophilic moiety 14 contacts substrate 1 and, moreover, the distribution of the molecules is uniform on the plane and forms a high density arrangement.

Therefore, according to the present invention, it is possible to solve problems of low sensitivity and others by aggregation of a dispersion pigment and others in the prior art and give an image quality of high sensitivity and high resolution.

In the above-mentioned example, the photosensitive member is prepared by LB method only. When the following means are used together, electrophotographic photosensitive members having better sensitivity and the like can be obtained. For example, since there is a correlation between the orientation of molecule and the absorption of light, this correlation can be used for controlling the orientation of molecules with respect to the direction of irradiating light upon forming the LB film by means of electromagnetic wave, ultrasonic wave or the like and thereby optimizing the sensitivity to produce electrophotographic photosensitive members of a higher sensitivity. Other than the time of preparing LB film, it is also possible after the formation of LB film to control the orientation by applying an electromagnetic field while heating. In addition, when 14 or 15 in FIG. 1 is a sensitization moiety, the sensitivity can be improved or the spectral sensitization can be achieved. It is also possible as mentioned above that 14 or 15 in FIG. 1 is a charge generation portion while 15 or 14 is a charge transport portion, that is, a molecule having a function separation action in the molecule itself can be used.

Figure 3:
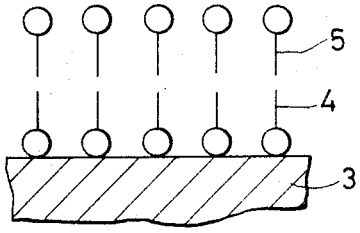

FIG. 3 is another embodiment of an electrophotographic photosensitive member of the present invention and a schematic vertical section showing the minute structure.

In this embodiment, in a way similar to FIG. 2, an electroconductive substrate 3 is used and LB method is applied to form a photosensitive layer of a multi-layer film constituted of two monolayer films 4 and 5. The built-up pattern of the monolayer film in FIG. 3 is an example of Y-type film.

When such a monolayer film as in FIG. 2 has an insufficient sensitivity, a photosensitive layer is constituted of two monolayer films as in this embodiment so as to improve the sensitivity of the electrophotographic photosensitive member. Naturally, if desired, it is possible to prepare a multi-layer film constituted of three layers, and further, the means of the previous example may be used to improve sensitivity and the like. For example, an LB film is formed such that 4 (or 5) is a group capable of sensitizing 5 (or 4) and thereby, the sensitivity is improved or the spectral sensitization is possible.

Further, a photosensitive layer of a function separation type may be prepared in the case of the multi-layer film of this embodiment by making 4 (or 5) a charge generation layer and 5 (or 4) a charge transport layer.

Figure 4:
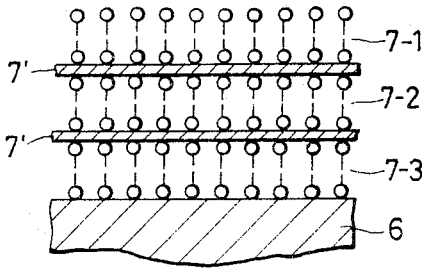

FIG. 4 is a further embodiment of the electrophotographic photosensitive member of the present invention and a schematic vertical section showing the minute structure.

In FIG. 4, 6 is an electroconductive substrate. 7 -1, 7 - 2 and 7 - 3 are photosensitive layers each of which is constituted of a multi-layer film composed of two monolayer films. 7' is an electroconductive substrate or film provided between photosensitive layers 7 - 1 and 7 - 2, or between photosensitive layers 7 - 2 and 7 - 3.

The electrophotographic photosensitive member of this embodiment can be prepared by forming photosensitive layer 7 - 3 on substrate 6 by LB method, forming 7' on 7 - 3 by a dipping method, and repeating the procedure. According to the construction of this embodiment, an electrophotographic photosensitive member having the following characteristics can be manufactured.

Figure 5:
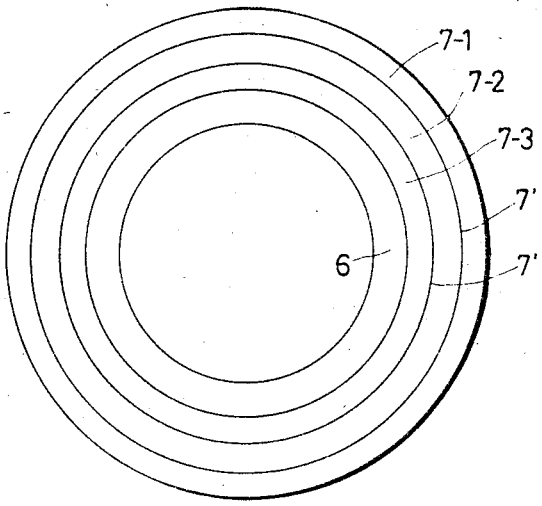
FIGS. 5 and 6 show schematically cross-sectional views of embodiments of the electrophotographic photosensitive member according to the present invention.
Figure 6:
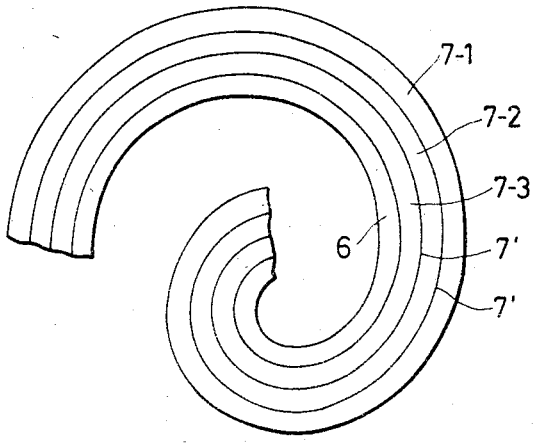

A substrate is made cylindrical and a film of the above-mentioned structure is formed on the substrate to produce an electrophotographic photosensitive member of a multiple doughnut type as illustrated in FIG. 5. Alternatively, a substrate of a sheet type is used and a roll winding-up type electrophotographic photosensitive member is formed as shown in FIG. 6.

According to the above-mentioned structure, the outermost layer can be peeled off after every step of electrophotography, or when desired, and thereby a new layer can be used for the next electrophotographic process. Thus, the above method can solve the problem of refreshing of photosensitive members which can not be solved by the prior art.

According to the above-mentioned structure, after developing the images on the surface of 7 - 1 with a toner, it is also possible to transfer the LB film itself together with the toner images to a receiving member. This structure can be used not only where the development is effected by electrostatically attaching a toner to the surface of the photosensitive member, but also where the development is conducted by a chemical reaction such as a silver salt development since the LB film can be peeled off.

Figure 7:
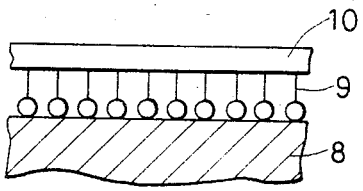
Figure 8:
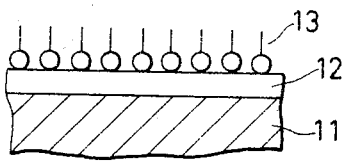

FIGS. 7 and 8 are still further embodiments of the electrophotographic photosensitive member of the present invention and the photosensitive layer is formed by combining with a known photosensitive member.

In FIG. 7, 8 is an electroconductive substrate, and 9 is a charge generation layer of a function separation type formed on substrate 9 and composed of a monolayer film produced by LB method. A charge transport layer 10 composed of a known photosensitive member such as hydrazines and formed on the LB film by a dipping method or the like.

The constitution of the electrophotographic photosensitive member in FIG. 8 is the reverse of that in FIG. 7, that is, the charge generation layer 12 is made of a known photosensitive member as above and the charge transport layer 13 is composed of a LB film. 11 is an electroconductive substrate.

In FIGS. 7 and 8, a monolayer film is shown, but naturally it is possible to use a multi-layer film instead.

According to the above-mentioned structures, there are obtained photosensitive members of higher resolution and higher sensitivity than the prior art.

In the above description, there is not mentioned anything in particular, but various layers as mentioned above, for example, an adhesive layer, a surface protective layer, an electroconductiye layer, a reflection preventing layer and the like, may be provided optionally on the substrate, on or under the LB film, or between the LB films, between the substrate and the LB film.

For example, an adhesive layer is formed on the surface of each of electroconductive substrates 1, 3 and 6 in FIGS. 2–4, or an electroconductive polymer is applied to the surface. Further, a surface protective layer may be provided on LB films 2, 4, 5, 7 - 1, 7 - 2 and 7 - 3.

An adhesive layer, an electroconductive layer or a surface protective layer may provided between 4 and 5.

The following example is given for illustrating the present invention, but not for limitation thereof.

EXAMPLE 1

A plate-like aluminum substrate having a sufficiently clean surface was prepared. A film-forming molecule was made by introducing carboxyl group and n-octadecyl group into a polyvinylcarbazole skeleton having photosensitivity to impart hydrophilicity and hydrophobicity. Then LB film was formed by the above-mentioned vertically dipping method and thus, an electrophotographic photosensitive member composed of a monolayer film as shown in FIG. 2 was produced.

The resulting photosensitive member was set on an electrophotographic device to form latent images by applying charging corona voltage of +5 kv, imagewise exposure at 1–2 lux.sec., and the resulting latent images were developed, transferred and fixed according to a known method. Image evaluation was made for every 100th sheet sample by effecting image formation of total 10,000 sheets using A - 4 size paper. Evaluation items were density, resolution, gradation, image defect and the like of the images.

For all of these items, the electrophotographic photosensitive member prepared by this example was remarkably better than that of the prior art.

EXAMPLE 2

Using the same substrate and the same film forming molecule as in Example 1, an electrophotographic photosensitive member composed of a multi-layer film as shown in FIG. 3 was formed by the same manner as in Example 1. The resulting photosensitive member was set on an electrophotographic device and an image evaluation was carried out by the same manner as in Example 1.

For all of the evaluation items, the photosensitive member of this example was far better than Example 1.

EXAMPLE 3

LB film was formed by the same manner as in Example 1 except that copper phthalocyanine skeleton was used in place of polyvinylcarbazole. Ten layers of the resulting LB film as a charge generating layer were built up and, further, twenty layers of LB molecule of hydrazine skeleton as a charge transporting layer were built up. For the resulting layer, an image evaluation was carried out by the same manner as in Example 1 and gave the same good results as described above.

EXAMPLE 4

Photosensitive molecules were dispersed in a non-photosensitive LB film.

Copper phthalocyanine or azobenzene derivatives having the following structural formula as a photosensitive molecule was dispersed in an LB layer comprising arachidinic acid ($CH_3(CH_2)_{18}COOH$), a non-photosensitive molecule. For the resulting layer, an image evaluation was carried out by the same manner as Example 1 and gave the same good results as described above.

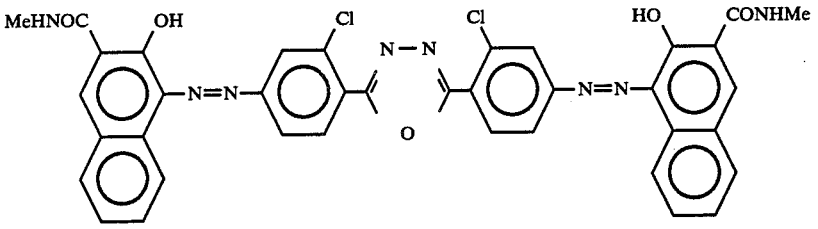

As explained above, by LB method, each molecule is arranged in an orderly fashion and, further, a high density monolayer film or multi-layer film is formed. Therefore, the electrophotographic photosensitive member of the present invention composed of such a monolayer film or multi-layer film is free from the problems of low sensitivity and the like, due to aggregation of a dispersion pigment and the like in the prior art and gives an image quality of high sensitivity and high resolution.

By utilizing the building-up characteristics of the film and the controllable property of orientation of a film forming molecule by an external force such as electromagnetic field and the like, there can be produced an electrophotographic photosensitive member of a far higher sensitivity.

What is claimed is:

1. A photoconductive member which comprises a substrate and at least one monomolecular layer on said substrate, said layer comprising a plurality of film-forming molecules, each molecule exhibiting photoconductivity and having a hydrophilic moiety and a hydrophobic moiety; wherein the layer is formed such that the hydrophilic moiety of each molecule is uniformly aligned and the hydrophobic moiety of each molecule is uniformly aligned.

2. The member of claim 1 comprising a plurality of said monomolecular layers on said substrate, in which the hydrophilic moieties in adjacent monomolecular layers uniformly oppose each other and the hydrophobic moieties in said adjacent monomolecular layers uniformly oppose each other.

3. The member of claim 1 comprising a plurality of said monomolecular layers substrate, in which the hydrophobic moieties in each said monomolecular layer are oriented toward the substrate.

4. The member of claim 1 comprising of plurality of said monomolecular layers on said substrate, in which the hydrophilic moieties in each said monomolecular layer are oriented toward the substrate.

5. The member of claim 1 comprised of a plurality of said monomolecular layers wherein adjacent layers are formed from different film forming molecules.

6. The photoconductive member of claim 1, wherein a portion of the molecule exhibiting photoconductivity is selected from the group consisting of porphyrin ring radical, anthracene ring radical, phenanthrene ring radical, diazo radical, polyvinyl radical, polyethynyl radical, hydrazine radical, phthalocyanine radical and the derivatives thereof.

7. The photoconductive member of claim 1, wherein the monomolecular layers comprise an electric charge-generating layer and an electric charge-transferring layer.

8. The member of claim 1 in which the substrate is electroconductive.

9. The member of claim 1 in which the monomolecular layer is formed by a Langmuir-Blodgett layer-forming process.

10. The member of claim 2 in which the hydrophilic moieties in adjacent layers are aligned in opposition and the hydrophobic moieties on adjacent layers are aligned in opposition by conducting a Langmuir-Blodgett layer-forming process.

11. The member of claim 3 in which the hydrophobic moieties in each said monomolecular layer are oriented toward the substrate by conducting a Langmuir-Blodgett layer-forming process.

12. The member of claim 4 in which the hydrophilic moieties in each said monomolecular layer are oriented toward the substrate by conducting a Langmuir-Blodgett layer-forming process.

13. An electrophotographic photosensitive member which comprises a substrate for electrophotography and at least one monomolecular layer on said substrate, said layer comprising a plurality of film-forming molecules, each molecule exhibiting photoconductivity and having a hydrophilic moiety and a hydrophopic moiety; wherein the layer is formed such that the hydrophilic moiety of each molecule is uniformly aligned and the hydrophobic moiety of each molecule is uniformly aligned.

14. A photoconductive member which comprises (a) a substrate; (b) at least one monomolecular layer on said substrate, said layer comprising a plurality of film-forming molecules, each molecule exhibiting photoconductivity and having a hydrophilic moiety and a hydrophobic moiety; wherein the layer is formed such that the hydrophilic moiety of each molecule is uniformly aligned and the hydrophobic moiety of each molecule is uniformly aligned, and (c) at least one photoconductive material interposed between said plurality of film-forming molecules in said layer.

15. The member of claim 13 in which the substrate is electroconductive.

16. The member of claim 14 comprised of a plurality of said monomolecular layers wherein adjacent layers are formed from different film forming molecules.

* * * * *